United States Patent [19]

Iida et al.

[11] 4,367,597

[45] Jan. 11, 1983

[54] GAS-LIQUID COOLING APPARATUS

[75] Inventors: Hiroshi Iida; Tetuya Ohara, both of Himeji; Masakatu Tuji, Hyogo, all of Japan

[73] Assignee: Nippon Steel Corporation, Tokyo, Japan

[21] Appl. No.: 211,716

[22] Filed: Dec. 1, 1980

[30] Foreign Application Priority Data

| | | | |
|---|---|---|---|
| Dec. 13, 1979 | [JP] | Japan | 54-161914 |
| Sep. 29, 1980 | [JP] | Japan | 55-135680 |
| Sep. 29, 1980 | [JP] | Japan | 55-135681 |

[51] Int. Cl.[3] ..... F26B 13/02

[52] U.S. Cl. ..... 34/155; 34/20; 34/160; 134/102; 134/122 R; 239/433

[58] Field of Search ..... 34/9, 20, 83, 155, 156, 34/160; 266/218, 219, 259; 95/60; 239/433, 429, 418; 134/64 R, 64 P, 122 R, 122 P, 102

[56] References Cited

U.S. PATENT DOCUMENTS

| | | | |
|---|---|---|---|
| 1,999,832 | 4/1935 | Dreffein | 266/259 |
| 3,323,577 | 6/1967 | Clumpner | 266/259 |
| 3,827,639 | 8/1974 | Relue et al. | 34/156 |
| 3,934,641 | 1/1976 | Chielens | 239/433 |

*Primary Examiner*—Larry I. Schwartz

*Attorney, Agent, or Firm*—Wenderoth, Lind & Ponack

[57] ABSTRACT

A gas-liquid cooling apparatus having a group of gas jet nozzles and a group of liquid jet nozzles so that the gas jet stream from the gas jet nozzles intersects with the liquid jet stream from the liquid jet nozzles at an acute angle so as to form a gas-liquid mixture, the improvement comprising a liquid guide means for collecting the liquid which is separated from the gas-liquid mixture and which is reflected from a material to be cooled and for carrying the collected liquid away from the material.

8 Claims, 15 Drawing Figures

GAS-LIQUID COOLING APPARATUS

The present invention relates to a gas-liquid mixture jet cooling apparatus suitable for cooling a band-shaped material, especially a steel plate strip in the course of its successive heat treatments.

There has been a marked tendency of late for the heat treatment of a steel plate strip to be made in the course of high speed transfer of the strip within a continuous heat treating furnace. The cooling of such strip in the course of its transfer is important.

As a cooling means for the steel strip, there is one means that utilizes a stream of a gas-liquid mixture (hereinafter referred to as "a gas-liquid"). This has the advantage of having a wide range of cooling rates but since the handling thereof after the completion of injection of the gas-liquid is cumbersome, it is difficult to control cooling and no satisfactory means to do so has been developed so far.

The term "gas-liquid" or "gas-liquid mixture" as used herein refers to a fluid which is produced by a process in which a high speed gas and a liquid of a predetermined pressure are injected from their respective nozzles as jet streams and these streams are then mixed with each other by being crossed with each other so that the liquid (e.g., water) is broken up into fine particles mixed in the gas in the form of mist, or in a form almost equivalent to spray.

A gas-liquid cooling apparatus has been proposed, which comprises a series of gas jetting slit nozzles in a row and a series of liquid jet nozzles in a row wherein the gas jetting slit nozzles have a plurality of parallel gaps defined by a desired number of spacers while the liquid jet nozzles are provided with a number of small holes so that streams of a liquid discharged therefrom intersect with those of a gas discharged from the gas jet nozzles at an acute angle.

In the conventional gas-water cooling apparatus, a gas-water jet is applied to the surface of a hot strip and, thus, the water separated from the gas-water jet after its collision with the hot strip scatters over that surface and therearound which not only interferes with the continuation of gas-water jetting but also causes irregularities in the cooling rate thereof, which is represented by the heat transmission efficiency [Kcal/$m^2$hr° C.] or the cooling velocity [°C./sec] with respect to a steel plate (strip) having a predetermined temperature and spaced at a predetermined distance from the front end of the nozzle and which is determined by the density of the air ($Nm^3/m^2$ min) and that of the water ($l/m^2$·min) used. For example, when the scattered water remains on the surface of the strip in the form of a water film, the gas-water ejected thereon can cool the surface only indirectly through the film so that the cooling rate is reduced and irregularities in cooling take place. Such irregularities make it difficult to control cooling.

Further, the scattering of water around the strip is not desirable because such scattered water is driven toward the strip during the continuation of the gas-water injection.

On the other hand, when, in a continuous annealing line, a hot strip heated up to and kept at a high temperature in heating and soaking sections is quenched in a cooling section to thus follow a desired heat treating pattern and is subsequently transferred to an overaging section, it is desirable that the strip be transferred to the above mentioned overaging section while it is kept at its finally required temperature.

Furthermore, the spacers define gas jetting passages which are spaced equidistantly side by side in a line and which extend in a parallel relationship with the gas jetting direction. Each of the spacers has a tapered front (outer) end and a tapered rear (inner) end. These ends are inclined inwardly with respect to the center axis of the corresponding spacers. However, due to the tapered front ends of the spacers, the resultant stream of gas-liquid mixture tends to be broken into several parts in the direction of the row of nozzle (see FIG. 11) and it is impossible for the nozzle to form a spray pattern uniformly distributed in the direction of the row of nozzles.

The above phenomenon has been considered to be due to the streams of gas generated between the liquid nozzles, which streams separate the entire stream of the mixture and it would therefore be possible to prevent such separating or division of the stream of the mixture if the above mentioned gas streams generated between the liquid nozzles were eliminated.

The primary object of the present invention is to remove from the surface of the cooling material and therearound the water separated from the gas-water quickly and properly to thereby provide an atmosphere suitable for performing effective and uniform cooling and its control.

The secondary object of the present invention is to make sure that the formation of rifts in the gas-liquid stream can be prevented.

According to the present invention, the liquid (e.g., water) separated from the gas liquid after the completion of cooling of the material to be cooled (strip) is removed from the material and the space therearound.

The gas liquid cooling apparatus of the present invention comprises a gas jet nozzle (or nozzles) arranged close to the material (e.g. a hot steel plate strip and the like), a liquid jet nozzle (or nozzles), a gas supply header, and a liquid supply header.

According to an embodiment of the present invention, the gas jet nozzle comprises a slit of a predetermined width or a plurality of rectangular small holes each capable of discharging a high speed gas jet stream upwardly with respect to the horizontal plane so that a gas stream in the shape of a riftless gas curtain is formed extending in the direction of the width of the material to be cooled.

As a gas source, air may be used, but to cool a hot steel strip and the like, it is advantageous to use inert gases (such as $N_2$ gas, $CO_2$ gas, Ar gas etc.) because they are effective for the prevention of oxidation and they may be collected for re-use.

When these gases are re-used, it is desirable to cool and dehumidify them.

According to the present invention, preferably, the liquid jet nozzle comprises a group of small nozzle holes angled upwardly with respect to the horizontal plane at positions right beneath the gas jet nozzle so that each of them discharges a jet stream intersecting with the gas jet stream from the gas jet nozzle to obtain an upwardly angled gas-liquid mixture which is formed outside the apparatus.

As a liquid source, water is preferable for of economy but other liquids may be used so long as they have sufficient cooling capacities and they are not detrimental to the material to be cooled.

Preferably, the liquid jet nozzle is positioned below the gas jet nozzle because by so doing, it is possible to obtain a uniform flow rate of discharge in the direction of the width of the material even when the flow rate of the liquid is varied.

Referring to the angle of discharge of the gas-liquid, preferably, the gas-liquid mixture obtained by the above described process is directed onto the vertically moving material to be cooled, upwardly with respect to the horizontal plane, for example, at a velocity of about 40 to 100 m/sec.

The greater part of the gas-water thus directed is reflected upwardly by the surface of the material in the direction opposite to the direction of discharge of the gas liquid just like in the relationship of an incidence angle and a reflection angle and is then separated into gas and liquid.

If the gas-liquid is directed in the horizontal direction, the preceding gas-liquid and the succeeding gas-liquid will interfere with each other and, as a result, they will scatter on the surface of the material and therearound to finally form or become liable to form a liquid film on that surface so that irregularities may take place or would be liable to take place during cooling and hence it would become difficult to produce effective cooling or cooling control.

From the above explanation, it will be understood that it is possible to effect gas-liquid cooling uniformly and effectively by directing the gas-liquid upwardly with respect to the horizontal direction.

Regarding the angle of discharge of the gas-liquid, any angle can achieve the purpose of the invention provided that it is sufficient to cause the gas-liquid to be directed upward with respect to the horizontal plane but in practice, it is established depending on the distance between the gas-liquid jet unit (gas and liquid jet nozzles) and the material to be cooled and the position and the configuration of a liquid guide plate which will be described hereinafter. This guide plate receives and drives liquid separated from the gas-liquid due to the reflection of the latter from the material being cooled.

The liquid guide plate is adapted to receive the greater part of the liquid separated from the gas-liquid and to carry it away quickly from the material to be cooled. Accordingly, it is arranged at a position where the above described separated liquid falls down. In actual practice, it may be in the form of any inclined plate capable of guiding the liquid it receives on or above the gas header to a position away from the material as completely as possible and the angle of inclination and the dimensions thereof can be determined properly in proportion to the amount of the liquid.

The liquid guide plate may be in the form of a flat plate or a trough or the like.

With the above structure, the greater part of the injected gas-liquid is separated quickly and positively from the material to be cooled and, therefore, a uniform gas-liquid cooling can be achieved.

As a result, it can produce an effect that the cooling control for the material can be easily carried out.

According to the present invention, the gas-liquid jet units may be provided in a plurality of layers on opposite sides of the material to be cooled which continuously travels in the vertical direction to thereby obtain a predetermined cooling rate using a plurality of the units.

With such multiple units, it is desirable that the gas-liquid jet units be arranged in such a manner that the gas-liquid discharge positions of the units facing one side (the front surface) of the material to be cooled and those of the units facing the other side (the rear surface) thereof do not overlap but are displaced from each other vertically or in the right and left directions or in both of these directions, so that both surfaces of the material can be cooled uniformly.

If the units are arranged in the above fashion, the material can be cooled without giving rise to an undesirable effect on its configuration.

Further, with such an arrangement, even a narrow material can be cooled without its side portions being affected adversely since the gas-liquid jets applied outside the material do not run against one another.

It is possible to provide a cooling chamber by shielding the above described multilayered gas-liquid jet units in their entireties with shielding plates blocking out the atmosphere and to make such cooling chamber a one unit cooler. Also it is possible to use a plurality of such cooler units.

In the cooling chamber of the above structure, it is possible to vary the cooling rate by controling the individual cooler units by ON-OFF operations.

Further, the gas and the liquid (water) separated from the gas-liquid after discharge as explained hereinbefore can be removed by means of separate exhaust means through gas exhaust ports provided, for example, on both sides of the cooling chamber and through liquid exhaust ports provided, for example, at the bottom of the chamber, respectively. The discharged gas and liquid can be re-used after they are collected and treated. Embodiments of the present invention, especially as it is used for cooling a steel strip in the course of its treatment in a continuous heat treatment furnace, will now be explained with reference to the accompanying drawings wherein:

Figure 14:
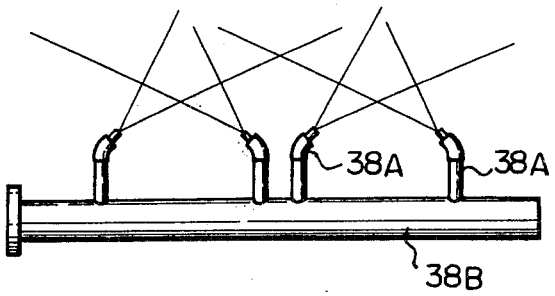
Figure 15:
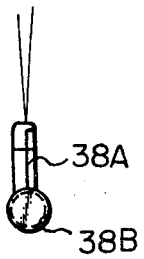

FIG. 14 is a plan view of a water spray nozzle arrangement according to the present invention; and, FIG. 15 is a side view of the arrangement of FIG. 14. Referring to FIGS. 1–4, reference numeral 21 indicates a gas supply header which is connected to a gas supply source (not shown), and 22 indicates nozzle forming plates attached to the gas supply header 21 in the longitudinal direction of the latter. These nozzle forming plates 22 which constitutes part of first nozzle means are spaced from one another at a predetermined distance and are held by bolts 13 to provide therebetween a slit-like gas jetting nozzle opening 24.

To the plates 22 is attached a unit pipe 26 in the vicinity of the opening 24. The unit pipe 26 is held by brackets (not shown) which are connected to the plates 22 by means of the bolts 13. The pipe 26 has a plurality of liquid jet nozzles 27 arranged at predetermined intervals so that a liquid is discharged therefrom just in front of the nozzle opening 24. Pipe 6 and nozzles 27 constitutes second nozzle means.

Spacers 25 positioned between plates 22 define a group of gas jet nozzles in the form of parallel rectangular ports 24A within the nozzle opening 24. The liquid jet nozzles 27 are located below and adjacent to the gas jet nozzles 24A. The spacers 25 and the nozzle forming plates 22 constitute the first nozzle means.

These nozzles 24A are directed upward with respect to the horizontal plane at an angle of inclination of $\alpha$ and the nozzles 27 are directed upward so as to intersect with the corresponding nozzles 24A at an acute angle so that the gas jet discharged from each of the nozzles 24A and the liquid discharged from each of the nozzles 27 are mixed in front of the nozzles 24A to produce an upwardly directed gas-liquid jet flowing, for example, at a velocity of 40 to 100 m/sec.

As a gas source, for example, $N_2$ gas of nearly 1500 mm Aq is supplied through the gas supply header 21 while a suitable quantity of liquid is supplied through the unit pipe 26 which is connected to the liquid supply source (not shown). The upper nozzle forming plate 22 which forms a part of the gas supply header 21 is inclined rearwardly of each of the nozzles 24A and receives and conducts the liquid, which is reflected from the vertically moving hot strip 100 and separated from the gas-liquid, away from the strip. Instead of the provision of inclined nozzles 24A and plates 22, these may be horizontal. However, in this case the apparatus itself is installed at an angle of $\alpha$, with respect to the horizontal plane.

If necessary, a cover 28 which is a part of the plate 22 can be provided on the nozzles 24A to protect the liquid nozzles 27 in case the strip runs against the gas-liquid jet unit 40 accidentally. However, it goes without saying that even with the cover 28, no change will take place in the functioning of the unit.

The spacers 25 are identical to spacers 5 of an embodiment illustrated in FIGS. 5–9, which will be explained hereinafter.

FIGS. 5–9 illustrate another embodiment of the present invention. The gas supply header 1 is connected to a gas supply source (not shown). The nozzle forming plates 2 are attached to the gas supply header 1 in the longitudinal direction. These nozzle forming plates 2 which form part of first nozzle means are spaced from one another at a predetermined distance and are held by bolts 13 to provide therebetween a slit-like gas jetting nozzle opening 4.

Figure 7:
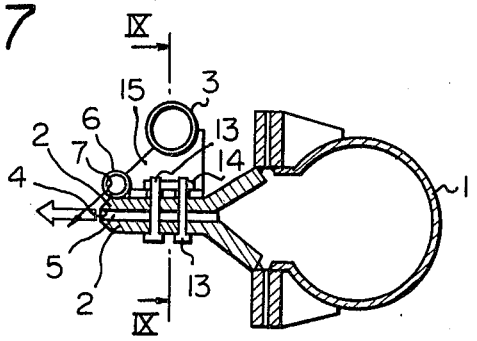
FIG. 7 is a cross sectional view taken along the line VII—VII in FIG. 6.
Figure 8:
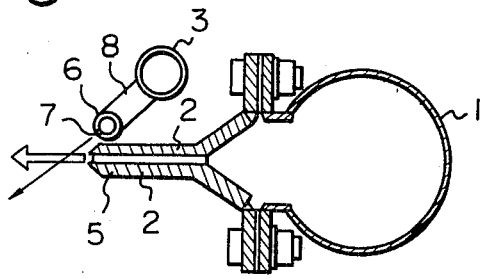
FIG. 8 is a cross sectional view taken along the line VIII—VIII in FIG. 6.
Figure 9:
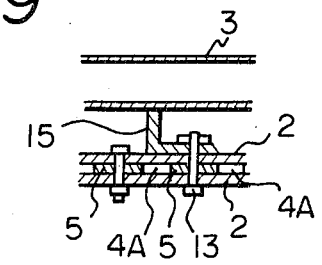
FIG. 9 is a longitudinal sectional view taken along the line IV—IV in FIG. 7.

To the plates 2 is attached a unit pipe 6 which constitutes a second nozzle means in the vicinity of the opening 4. The unit pipe 6 is held by brackets 15 which are connected to the plates 2 by means of the bolts 13 and retaining plates 14 (FIG. 7). The pipe 6 has a plurality of liquid jet nozzle holes 7 arranged at predetermined intervals so that a liquid is discharged therefrom just in front of the nozzle opening 4. The liquid is supplied through connecting pipes 8 from a liquid supply pipe 3 which is connected to a liquid supply source 48 (FIG. 12) and which is held by the brackets 15.

In the embodiment shown in FIGS. 5–9, the nozzle opening 4 extends horizontally and the nozzle holes 7 open in the direction intersecting the horizontal extension of the opening 4 at an acute angle.

A plurality of spacers 5 are interposed between the nozzle plates 2 at predetermined intervals in the longitudinal direction of the nozzle plates 2 in such a manner that each of the spacers 5 extends parallel to the gas jetting direction and by these spacers there are formed a group of gas jet nozzles in the form of spaced parallel rectangular ports 4A within the nozzle opening 4. Thus, a harmonica type of nozzle arrangement is provided which constitutes the first nozzle means.

Each of the spacers 5 has a tapered inner or rear end 5B and a flat outer or front end 5A, according to the present invention.

Figure 10:
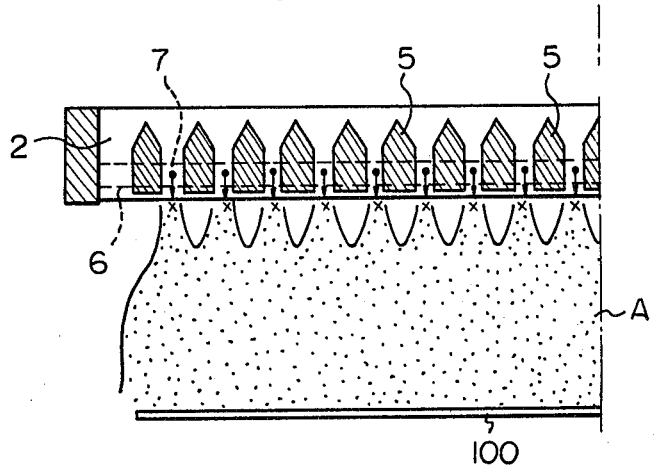
FIG. 10 is a view illustrating a gas-liquid mixture stream forming pattern produced by use of the apparatus according to the present invention.

By the provision of the spacers 5 with flat front ends at predetermined intervals over the entire width of the slit-like gas jetting nozzle opening 4, negative pressure or vacuum zones are provided in front of and adjacent to the spacers 5, respectively, due to the jet streams discharged from the ports 4A on both sides of each of the spacers 5 and, therefore, the streams of the gas-liquid mixture which are formed by a gas discharged from the ports 4A and a liquid discharged from the liquid jet nozzle holes 7 located on both sides of each of the spacers 5 and which are formed at positions just in front of the group of the gas jet nozzles 4A, are attracted to one another due to the existence of the above described vacuum zones so that a curtain like jet stream of mixture A (FIG. 10) is obtained, which is uniformly distributed in the direction of the width of the entire nozzle.

The attraction is considered to be due to the so called "Coanda effect" in fluid mechanics.

The steel strip 100 is conveyed in the vertical direction, i.e. in a direction perpendicular to the plane of the drawing.

Figure 11:
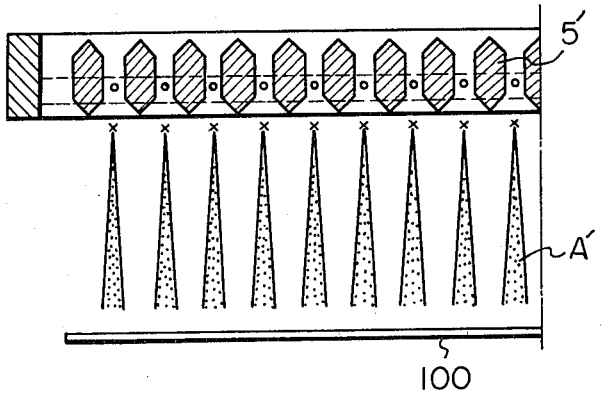
Fig. 11 PRIOR ART
FIG. 11 is a view illustrating a gas-liquid mixture stream forming pattern produced by use of a prior art apparatus which includes spacers having tapered front and rear ends.

In a prior art apparatus, the spacers 5' do not have flat front ends, and accordingly, no Coanda effect occurs, so that the mixture A' is separated into several streams, as described above and as illustrated in FIG. 11. That is, no vacuum zone is produced in front of each of the spacers 5'.

As described above, it will be understood that the gas-liquid cooling apparatus according to the present invention makes it possible to obtain a spray pattern uniformly distributed in the direction of the width of the liquid jet nozzle. Furthermore, according to the present invention, the diameter of the nozzle holes can be increased to increase the cooling rate, while ensuring the provision of the curtain like gas-liquid stream.

Figure 1:
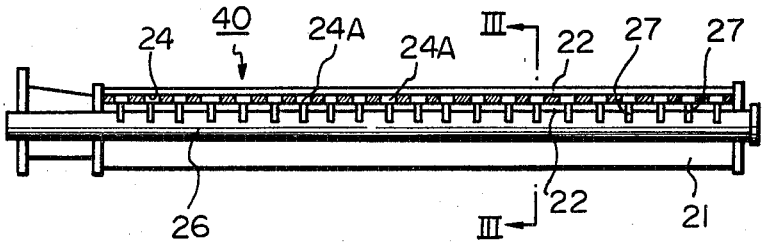
FIG. 1 is a front view of an embodiment of a gas-liquid cooling apparatus according to the present invention viewed from the side from which a stream of gas-liquid mixture is formed.
Figure 2:
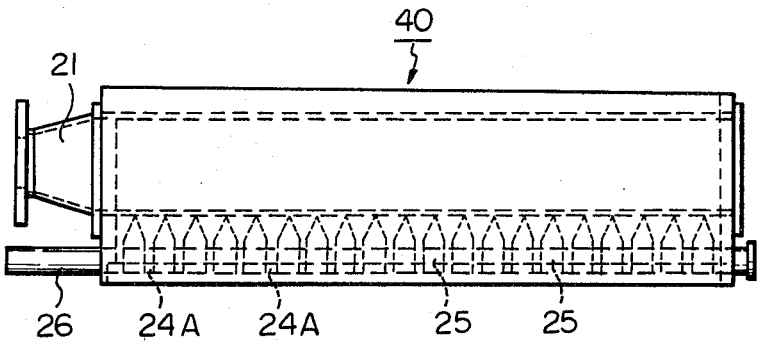
FIG. 2 is a plan view of the apparatus of FIG. 1.
Figure 3:
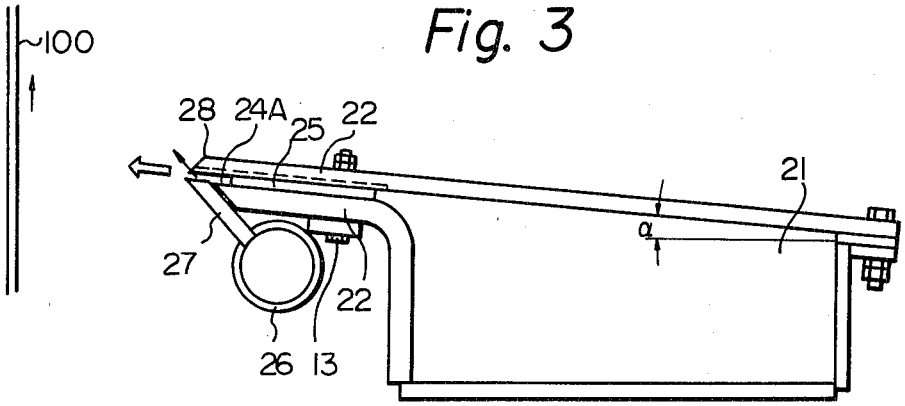
FIG. 3 is a sectional view taken along the line III–III in FIG. 1.
Figure 4:
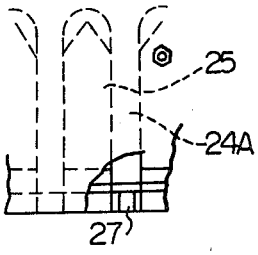
FIG. 4 is an enlarged view of a part of a nozzle unit shown in FIG. 2.
Figure 5:
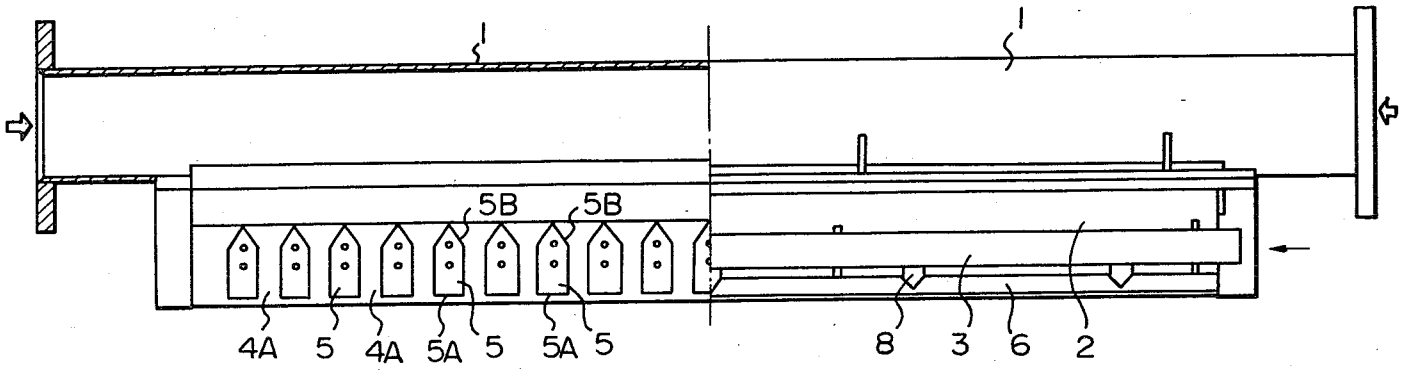
FIG. 5 is a plan view of another embodiment of a gas-liquid cooling apparatus according to the present invention, a part thereof being broken away.
Figure 6:
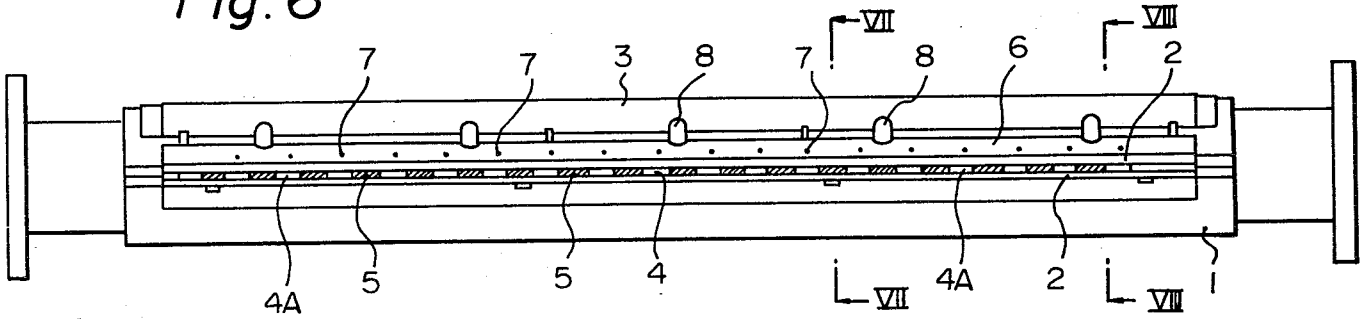
FIG. 6 is a front view of the apparatus of FIG. 5.
Figure 12:
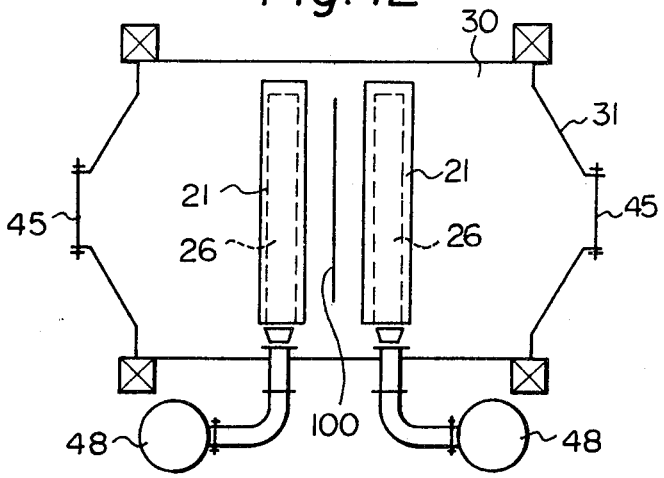
FIG. 12 is a plan view of a cooling chamber in which a plurality of gas-liquid jet units are arranged in a plurality of layers.
Figure 13:
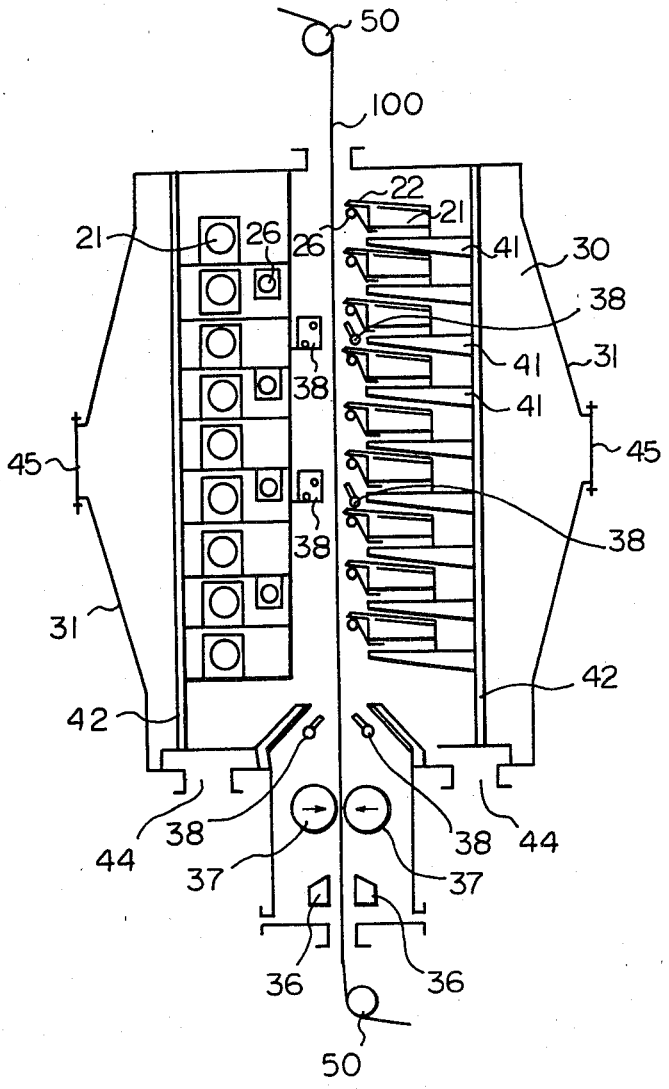
FIG. 13 is a side view of the cooling-chamber of FIG. 12, a part thereof being broken away and the right-hand side showing the nozzles and the left-hand side showing the mounting of the headers.

An example of an arrangement in which a plurality of the gas-liquid jet units 40 shown in FIGS. 1 and 2, according to the present invention are provided in a plurality of layers and on different levels is shown in FIGS. 12 and 13. The units are contained in a housing 31 defining a cooling chamber 30.

The hot strip 100 is transferred continuously and vertically downwardly in FIG. 13 by means of drive rollers 50 so as to be subjected to a predetermined cooling process.

The gas-liquid jet units 40 are arranged in a plurality of layers and are supported by brackets 41 so as to face the front and rear surfaces (both sides) of the strip 100 with a predetermined spacing from the latter. The units 40 on one side of the strip are vertically offset from those on the opposite side. At the lower portion of the housing 31 there are provided liquid drain ports 44 which are beneath the rear ends of units 40, i.e. ends remote from strip 100. On the both sides of the housing 31, there are provided gas exhaust ports 45.

According to the present invention, a desired number of water sprays 38 are provided along the direction of the movement of the strip 100 on both sides of the strip 100 at a predetermined spacing from the latter to blow off the water remaining on the strip 100. Since the strip 100 is subject to the water pressure of the water sprays 38, guide rollers 37 are provided to prevent deflections of the strip 100.

Also, on both sides of the strip 100 are provided gas jet means 36 for finally removing the water which may remain on the strip 100 in spite of the operation of the water sprays 38.

With the above structure, when a high speed gas-liquid jet is applied to the hot strip 100, it is reflected upwardly and the greater part of liquid separated from the gas-liquid jet is received by the plate 22 which is inclined rearwardly and downwardly and at the same time guided to flow away from the hot strip so as to be collected at the exhaust ports 44 through which it is discharged. The numeral 42(FIG. 13) designates posts to support the brackets 41.

Similarly, gas (e.g. $N_2$ gas) separated from the gas-liquid jet is collected through the exhaust port 45.

Water remaining on or adhered to the surfaces of the strip 100 is also discharged through the drain ports 44 after it is removed from those surfaces by means of the water sprays 38.

Likewise, water removed by the gas jet means 36 is discharged through the drain ports 44 while used gas is discharged through the exhaust ports 45 and is collected as required.

In the cooling chamber 30, there can be provided a suitable number of the water sprays 38 so that the water remaining on the strip 100 is easily removed from the strip at suitable positions thereof.

One example of such water sprays 38 is illustrated in FIGS. 14 and 15, each comprising spray nozzles 38A and a common main water feed pipe 38B which extends in the direction of the width of the strip 100. Each of the spray nozzles 38A removes the water remaining on the strip surfaces in the direction of the width of the strip by causing the spray of water therefrom intersect with that from the adjacent nozzle, so that it serves as a so-called water-knife.

Although the nozzles 38A have curved front ends, in the illustrated example, they may, of course, have straight front ends.

Further, the above described gas jet means 36 are provided within the cooling chamber 30 at a position near the outlet for the strip 100 so that the water remaining on the strip 100 can be easily removed by the gas jets (e.g. $N_2$ gas) without the strip's carrying such water thereon when it is transferred to the succeeding step.

Thus, according to the present invention, it is possible to remove without fail the water remaining on the strip, and, therefore the problem of indirect cooling arising from such water can be neglected and a desired final temperature can be given to the strip.

Further, where the gas-water jet units in a plurality of stages are arranged close to the strip, the strip passing through the clearance between the opposing rows of the gas-liquid jet units is liable to be deflected in proportion to its length and to prevent this, the guide rollers 37 are arranged at suitable positions.

These guide rollers 37 serve to restrict the rattling and twisting of the strip to a minimum which results in reducing the danger of the strip coming into contact with the gas-liquid jet units, the water sprays or the gas jet means.

Thus, according to the present invention, the greater part of the liquid used in cooling by the gas-liquid jet unit or units is carried away quickly and positively and, accordingly, an atmosphere suitable for effective cooling and its control is produced.

While the present invention has been described with reference, in the main, to a cooling apparatus incorporating multistaged gas-liquid jet units inclined at an angle of inclination of $\alpha$, it will be obvious that the present invention is not limited thereto and changes and modifications thereof may fall within the scope of the present invention unless they contradict the purposes of the present invention.

We claim:

1. A gas-liquid cooling apparatus for cooling a strip-like material moving substantially vertically, said apparatus comprising: a first nozzle means for discharging at least one gas jet stream and a second nozzle means for discharging at least one liquid jet stream in a direction intersecting the gas jet stream at an acute angle for forming only a single narrow jet of a gas-liquid mixture in front of said nozzle means; said apparatus being directed toward the material to be cooled with all of said jet of gas-liquid inclined upwardly toward the material at an angle for being bounced off said strip-like material at an angle of reflection substantially equal to the angle of upward inclination of said jet; one of said nozzle means having an inclined liquid guide plate thereabove extending at least as close to the material to be cooled as the outlet of said nozzle means for receiving substanially all of the gas-liquid mixture bounced off said strip-like material and inclined downwardly and away from the material for collecting the liquid which is separated from the gas-liquid mixture after it is bounced off the material to be cooled and carrying the liquid away from the material.

2. An apparatus according to claim 1 wherein said first nozzle means comprises a pair of plates spaced for defining therebetween a slit-like nozzle opening, and a plurality of spacers at a predetermined pitch along said opening and defining a plurality of nozzles for producing a single row of side by side jets, said pair of plates being above said second nozzle means, and the upper plate of said pair of plates being said liquid guide plate.

3. An apparatus according to claim 2 wherein each of said spacers has a flat end which is toward the material for establishing vacuum zones in front of the flat front ends when the gas is discharged from the nozzles.

4. An apparatus according to claim 2 wherein said second nozzle means comprises a unit pipe having a plurality of nozzle holes corresponding to and opening near the nozzles of said first nozzle means.

5. An apparatus according to claim 4 wherein said unit pipe is located below said first nozzle means and has nozzle pipes thereon which extend to a plane of the lower nozzle plate where said plane is extended toward the material, said nozzle pipes being at an acute angle to said plane.

6. A gas-liquid cooling apparatus for cooling a strip-like material moving substantially verically, said apparatus comprising: a plurality of nozzle units positioned vertically along and adjacent to the path of movement of the material, each unit having a first nozzle means for discharging at least one liquid jet stream and a second nozzle means for discharging at least one liquid jet stream in a direction intersecting the gas jet stream at an acute angle for forming only a single narrow jet of a gas-liquid mixture in front of said nozzle means; said units being directed toward the material to be cooled with all of said jet of gas-liquid inclined upwardly toward the material at an angle for being bounced off said strip-like material at an angle of reflection substantially equal to the angle of upward inclination of said jet; one of said nozzle means on each unit having an inclined liquid guide plate thereabove extending at least as close to the material to be cooled as the outlet of said nozzle means for receiving substantially all of the gas-liquid mixture bounced off said strip-like material and inclined downwardly and away from the material for collecting the liquid which is separated from the gas-liquid mixture after it is bounced off the material to be cooled and carrying the liquid away from the material.

7. An apparatus according to claim 6 in which there is a plurality of units on each side of said material, the units on one side of said strip being vertically offset from the units on the other side.

8. An apparatus according to claim 6 further comprising a housing around said units, said housing having a liquid discharge opening in the bottom thereof beneath each vertically positioned plurality of said units, said opening being beneath the ends of said units which are remote from the material, whereby the liquid carried away from the material on the liquid guide plates of each unit and falls to the bottom of said housing is removed from the housing.

* * * * *